US007926316B2

(12) United States Patent
Tachibana

(10) Patent No.: US 7,926,316 B2
(45) Date of Patent: Apr. 19, 2011

(54) TEMPERATURE CONTROL DEVICE FOR HOT ROLLING MILL

(75) Inventor: Minoru Tachibana, Tokyo (JP)

(73) Assignee: Toshiba Mitsubishi-Electric Industrial Systems Corporation, Tokyo (JP)

( * ) Notice: Subject to any disclaimer, the term of this patent is extended or adjusted under 35 U.S.C. 154(b) by 541 days.

(21) Appl. No.: 12/065,910

(22) PCT Filed: Jan. 30, 2007

(86) PCT No.: PCT/JP2007/051446

§ 371 (c)(1),
(2), (4) Date: Mar. 6, 2008

(87) PCT Pub. No.: WO2008/093396

PCT Pub. Date: Aug. 7, 2008

(65) Prior Publication Data

US 2010/0218578 A1 Sep. 2, 2010

(51) Int. Cl.
*B21B 37/74* (2006.01)
*B21B 27/06* (2006.01)
*G06F 19/00* (2006.01)

(52) U.S. Cl. ..... 72/8.5; 72/12.2; 72/201; 700/153

(58) Field of Classification Search ..... 72/8.5, 72/11.3, 12.2, 201, 342.2, 342.5; 700/153
See application file for complete search history.

(56) References Cited

U.S. PATENT DOCUMENTS 3,779,054 A * 12/1973 Greenberger ..... 72/12.2

FOREIGN PATENT DOCUMENTS

JP 8-243620 9/1996
JP 11-77134 3/1999

* cited by examiner

*Primary Examiner* — Dana Ross
*Assistant Examiner* — Mohammad Yusuf
(74) *Attorney, Agent, or Firm* — Leydig, Voit & Mayer, Ltd.

(57) ABSTRACT

A temperature control device for a hot rolling mill, preventing a sudden change in temperature of a rolled material near the delivery side of the rolling mill and realizing precise gauge control. The hot rolling mill has rolling stands arranged in a row and cooling devices for cooling the rolled material. The hot rolling mill is operated so that the cooling devices are preferentially used, in order, from one closest to the entry side until the upper limit pressure is reached. The cooling water pressure of each of the cooling devices is computed based on the target temperature of the rolled material and the actual temperature on the entry side. The cooling water pressure of the cooling device closest to the delivery side of the rolling mill is computed based on the target temperature of the rolled material and the actual temperature on the delivery side so the difference between the target temperature and the actual temperature on the delivery side is minimized.

1 Claim, 3 Drawing Sheets

TEMPERATURE CONTROL DEVICE FOR HOT ROLLING MILL

TECHNICAL FIELD

The present invention relates to a temperature control device for a hot rolling mill in which a plurality of rolling stands are arranged in a row to roll heated steel sheets etc. in succession by using these rolling stands.

BACKGROUND ART

In the rolling mill for rolling a rolled material such as a heated steel sheet, to enhance the quality of rolled product, it is important that the temperature of rolled material on the delivery side of the rolling mill be controlled so as to be a target temperature. Therefore, as a temperature control device for controlling the temperature of rolled material on the delivery side of the rolling mill so as to be the target temperature, various types of devices have been known conventionally.

For example, as the conventional art of the temperature control device for a hot rolling mill, a temperature control device has been proposed in which a plurality of cooling devices for cooling the rolled material are provided between the rolling stands arranged in a row (refer to Patent Documents 1 and 2). In the temperature control device described in Patent Document 1, cooling water is jetted out of the cooling device to cool the rolled material, and by regulating the number of jets, the temperature of the rolled material on the delivery side of the rolling mill is controlled. Also, in the temperature control device described in Patent Document 2, the flow rate of cooling water is corrected by using feedback control in order from the cooling device arranged closest to the delivery side of the rolling mill among the plurality of cooling devices, by which the temperature of the rolled material on the delivery side of the rolling mill is controlled.

Patent Document 1: Japanese Patent Laid-Open No. 8-243620

Patent Document 2: Japanese Patent Laid-Open No. 11-77134

DISCLOSURE OF THE INVENTION

Problems to be Solved by the Invention

To control the temperature of the rolled material on the delivery side of the rolling mill by using the temperature control device described in Patent Document 1, it is necessary to repeat the operation (jetting of cooling water) and stop of the cooling device. Therefore, the change in temperature of the rolled material is made large by the operation and stop of the whole of the cooling device, so that a limit is placed on highly precise temperature control. Also, the large change in temperature of the rolled material exerts an adverse influence on the sheet thickness accuracy.

On the other hand, in the temperature control device described in Patent Document 2, the flow rate of cooling water is changed in order from the cooling device arranged closest to the delivery side of the rolling mill, so that the temperature of the rolled material changes suddenly near the delivery side of the hot finish rolling mill. Therefore, there arises a problem in that disturbance is given to the auto gauge control (AGC), and therefore a great influence is exerted on the sheet thickness accuracy as well.

The present invention has been made to solve the above problems, and accordingly an object thereof is to provide a temperature control device for a hot rolling mill, which is capable of preventing a sudden change in temperature of a rolled material near the delivery side of the rolling mill and realizing highly precise control of the sheet thickness.

Means for Solving the Problems

A temperature control device for a hot rolling mill of the present invention is a temperature control device for a hot rolling mill having a plurality of rolling stands arranged in a row to roll a heated rolled material in succession by using the plurality of rolling stands, which comprises a plurality of cooling devices provided between the plurality of rolling stands to cool the rolled material by jetting cooling water, an entry side temperature meter for detecting the temperature of the rolled material on the entry side of the rolling mill, an delivery side temperature meter for detecting the temperature of the rolled material on the delivery side of the rolling mill, a first cooling water pressure computing section which computes the cooling water pressure of the cooling device in such a way that the cooling device is preferentially used in order from one closest to the entry side of the rolling mill among the plurality of cooling devices until the upper limit pressure is reached based on the target temperature of the rolled material on the delivery side of the rolling mill and the actual temperature thereof detected by the entry side temperature meter, a second cooling water pressure computing section which computes the cooling water pressure of the cooling device closest to the delivery side of the rolling mill among the cooling devices being operated based on the target temperature of the rolled material and the actual temperature thereof detected by the delivery side temperature meter in such a way that the difference between the target temperature and the actual temperature on the delivery side of the rolling mill is small, and a controlled object selecting section configured so that in the case where the cooling water pressure of the cooling device that is the controlled object of the second cooling water pressure computing section reaches the upper limit pressure as the result of the computation of the second cooling water pressure computing section, the controlled object selecting section changes the controlled object of the second cooling water pressure computing section to the cooling device arranged adjacently on the delivery side of the rolling mill, and in the case where the cooling water pressure of the cooling device that is the controlled object of the second cooling water pressure computing section reaches the lower limit pressure as the result of the computation of the second cooling water pressure computing section, the controlled object selecting section changes the controlled object of the second cooling water pressure computing section to the cooling device arranged adjacently on the entry side of the rolling mill.

EFFECT OF THE INVENTION

According to the present invention, the temperature control device for a hot rolling mill having a plurality of rolling stands arranged in a row to roll a heated rolled material in succession by using the plurality of rolling stands includes a plurality of cooling devices provided between the plurality of rolling stands to cool the rolled material by jetting cooling water, an entry side temperature meter for detecting the temperature of the rolled material on the entry side of the rolling mill, an delivery side temperature meter for detecting the temperature of the rolled material on the delivery side of the rolling mill, a first cooling water pressure computing section which computes the cooling water pressure of the cooling device in such a way that the cooling device is preferentially used in order from one closest to the entry side of the rolling mill among the plurality of cooling devices until the upper limit pressure is reached based on the target temperature of the rolled material on the delivery side of the rolling mill and the actual temperature thereof detected by the entry side temperature meter, a second cooling water pressure computing section which computes the cooling water pressure of the cooling device closest to the delivery side of the rolling mill among the cooling devices being operated based on the target temperature of the rolled material and the actual temperature thereof detected by the delivery side temperature meter in such a way that the difference between the target temperature and the actual temperature on the delivery side of the rolling mill is small, and a controlled object selecting section configured so that in the case where the cooling water pressure of the cooling device that is the controlled object of the second cooling water pressure computing section reaches the upper limit pressure as the result of the computation of the second cooling water pressure computing section, the controlled object selecting section changes the controlled object of the second cooling water pressure computing section to the cooling device arranged adjacently on the delivery side of the rolling mill, and in the case where the cooling water pressure of the cooling device that is the controlled object of the second cooling water pressure computing section reaches the lower limit pressure as the result of the computation of the second cooling water pressure computing section, the controlled object selecting section changes the controlled object of the second cooling water pressure computing section to the cooling device arranged adjacently on the entry side of the rolling mill. Thereby, a sudden temperature change of the rolled material near the delivery side of the rolling mill can be prevented, and therefore highly precise auto gauge control can be carried out.

DESCRIPTION OF SYMBOLS

Figure 1:
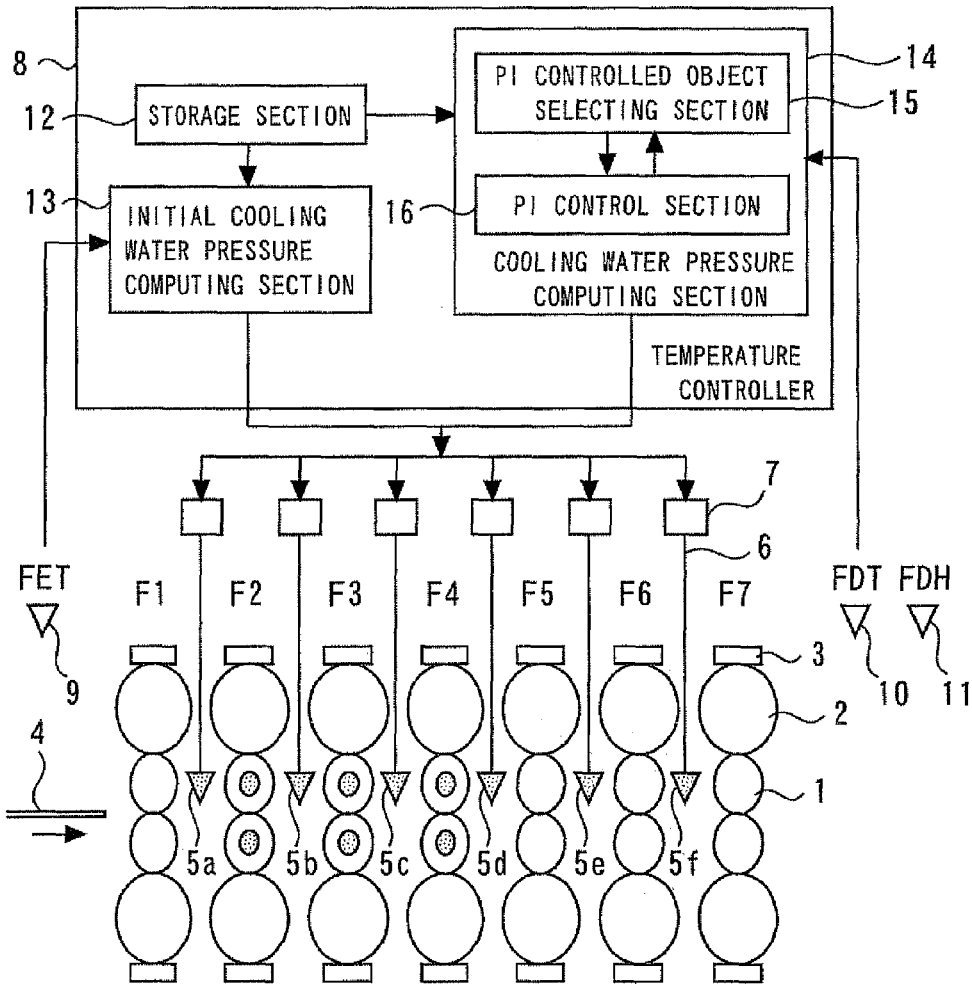
FIG. 1 is a general configuration view of a temperature control device for a hot rolling mill in accordance with a first embodiment of the present invention.

| | | |
|---|---|---|
| 1 work roll, | 2 backup roll, | 3 roll-gap control device, |
| 4 rolled material, | 5 cooling device, | 6 pipe, |
| 7 cooling water pressure control device, | 8 temperature controller, | |
| 9 finishing entry temperature meter, | | |
| 10 finishing delivery temperature meter, | | |
| 11 finishing delivery thickness meter, | 12 storage section, | |
| 13 initial cooling water pressure computing section, | | |
| 14 cooling water pressure computing section, | | |
| 15 PI controlled object selecting section, | 16 PI control section, | |
| 17 temperature control function, | 18 temperature control limiter, | |
| 19 valve opening control function | | |

BEST MODE FOR CARRYING OUT THE INVENTION

The present invention will now be described in detail with reference to the accompanying drawings. In the drawings, the same reference numerals are applied to the same or equivalent elements, and the duplicated explanation thereof is simplified or omitted as needed.

First Embodiment

Figure 2:
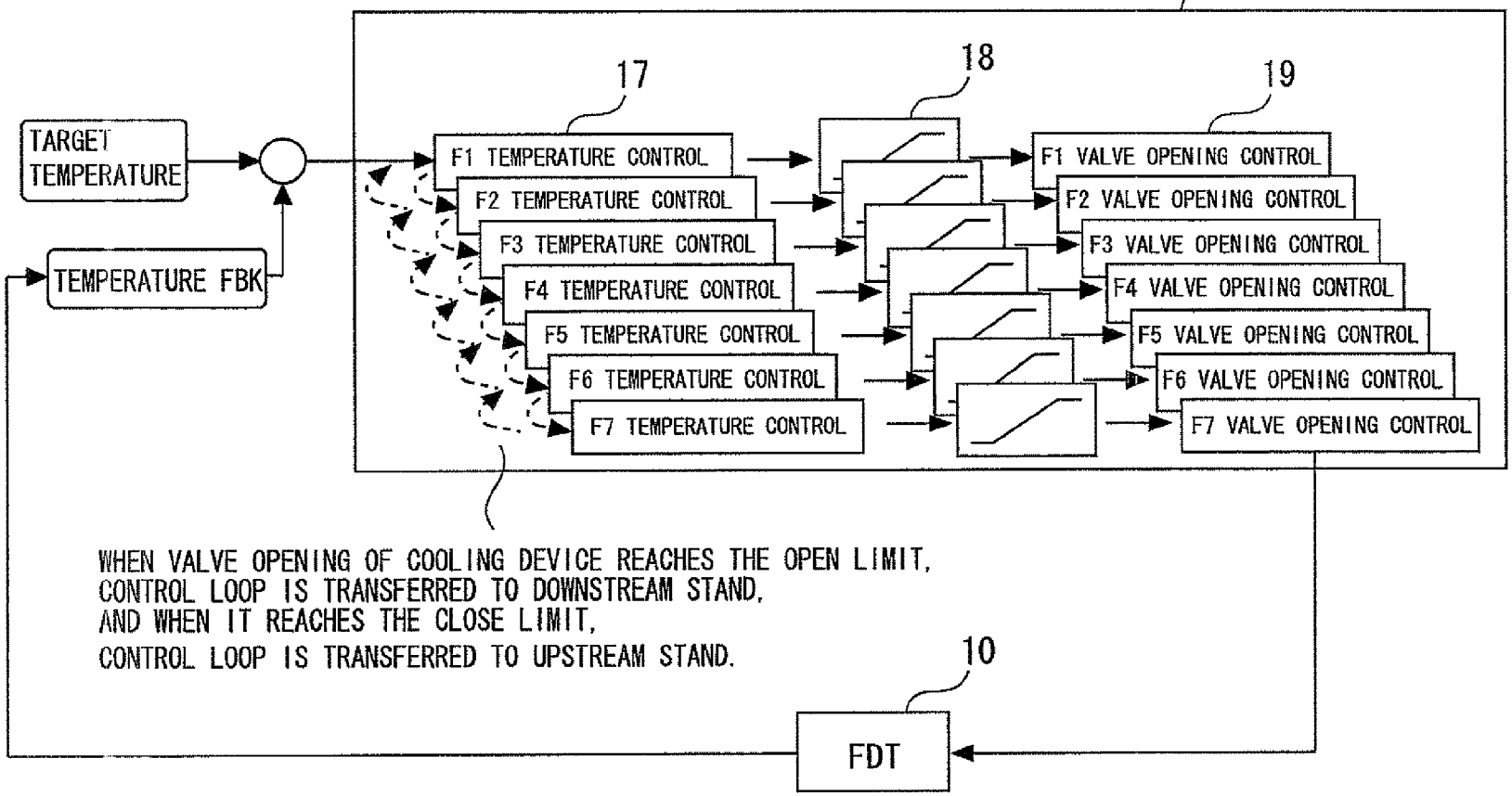
FIG. 2 is a configuration view showing an essential portion of the temperature controller in accordance with the first embodiment of the present invention.

FIG. 1 is a general configuration view of a temperature control device for a hot rolling mill in accordance with a first embodiment of the present invention, and FIG. 2 is a configuration view showing an essential portion of the temperature controller in accordance with the first embodiment of the present invention. In FIGS. 1 and 2, a hot finish rolling mill in which seven rolling stands (F1 to F7) are arranged in a tandem form is shown as one example.

First, the configuration of the temperature control device for a hot rolling mill is explained.

In FIGS. 1 and 2, each of the rolling stands F1 to F7 is provided with a work roll 1, a backup roll 2, a roll-gap control device 3, and the like. The rolling stands F1 to F7 are installed in order from the F1 stand to the F7 stand to roll a rolled material 4 by using the rolling stands.

Between the adjacent rolling stands F1 to F7, that is, between the F1 stand and the F2 stand, between the F2 stand and the F3 stand, . . . , between the F6 stand and the F7 stand, cooling devices 5*a* to 5*f* are provided respectively (in the case where any of the cooling devices 5*a* to 5*f* need not be identified, each of the cooling devices 5*a* to 5*f* is expressed as a cooling device 5). The cooling device 5 has a nozzle for jetting cooling water provided above the rolled material 4 that moves between the rolling stands. That is to say, the cooling device 5 jets cooling water to the top surface of the rolled material 4 from the upside to cool the rolled material 4.

Also, the cooling device 5 is connected with a cooling water pressure control device 7 via a pipe 6. The cooling water pressure control device 7 controls the pressure of cooling water jetted out of the corresponding cooling device 5. The cooling water pressure control device 7 carries out the control of the cooling device 5, that is, the control of cooling water pressure based on the computation result of a temperature controller 8, described later.

Reference numeral 9 denotes a finishing entry temperature meter provided on the entry side of the F1 stand, 10 denotes a finishing delivery temperature meter provided on the delivery side of the F7 stand, and 11 denotes a finishing delivery thickness meter provided on the delivery side of the F7 stand. The finishing entry temperature meter 9 detects the temperature of the rolled material 4 on the entry side of the hot finish rolling mill, and the finishing delivery temperature meter 10 detects the temperature of the rolled material 4 on the delivery side of the hot finish rolling mill. Also, the finishing delivery thickness meter 11 measures the sheet thickness of the rolled material 1 on the delivery side of the hot finish rolling mill. The temperature controller 8 computes the cooling water pressure necessary for the cooling water pressure control device 7 to control the cooling device 5 based on the actual temperature values of the rolled material 4 detected by the finishing entry temperature meter 9 and the finishing delivery temperature meter 10.

Specifically, the temperature controller 8 includes a storage section 12, an initial cooling water pressure computing section (first cooling water pressure computing section) 13, and a cooling water pressure computing section (second cooling water pressure computing section) 14. The cooling water pressure computing section 14 includes a PI controlled object selecting section 15 and a PI control section 16. The storage section 12 stores various parameters etc. necessary for computing the cooling water pressure. The parameters stored in the storage section 12 include, for example, a speed pattern at the time when the rolled material 4 is rolled, the target temperature, the target thickness, etc. of the rolled material 4.

The initial cooling water pressure computing section 13 computes the cooling water pressure of the cooling device 5 at the initial stage of rolling, for example, during the period of time when the actual temperature value of the rolled material 4 measured by the finishing delivery temperature meter 10 cannot be used, or during the period of time from before the sheet front end of the rolled material 4 enters into the F1 stand to when it arrives at the temperature detection position of the finishing delivery temperature meter 10. The cooling water pressure at the initial stage of rolling is computed by a predetermined calculating formula based on the target temperature of the rolled material 4 on the delivery side of the rolling mill, which is preset in the storage section 12, and the actual temperature value of the rolled material 4 detected by finishing entry temperature meter 9. That is to say, the cooling water pressure at the initial stage of rolling is computed so that the predicted temperature of the rolled material 4 at the time when the rolled material 4 arrives at the delivery side of the F7 stand becomes the target temperature. The predicted temperature is derived from the actual temperature value of the rolled material 4 detected by the finishing entry temperature meter 9, the speed pattern of the rolled material 4 stored in the storage section 12, and the like.

Also, the initial cooling water pressure computing section 13 computes the cooling water pressure of the cooling device 5 in such a way that the cooling device is preferentially used in order from one closest to the entry side of the rolling mill among the plurality of cooling devices 5 until the upper limit pressure is reached. That is to say, from the result of computation, in the case where desired cooling can be performed by only the cooling device 5*a* arranged closest to the entry side of the rolling mill, the cooling water pressure is computed and set so that the rolled material 4 is cooled by using only the cooling device 5*a*. Also, in the case where desired cooling cannot be performed by the use of only the cooling device 5*a* but can be performed by using the cooling devices 5*a* and 5*b*, the cooling water pressure is computed and set so that the rolled material 4 is cooled by using only the cooling devices 5*a* and 5*b*. In this case, the cooling water pressure is set at the upper limit pressure in the cooling device other than the cooling device 5*b* arranged closest to the delivery side of the rolling mill of the used cooling devices 5*a* and 5*b*. The same holds true in the case where desired cooling cannot be performed by the use of only the cooling devices 5*a* and 5*b*.

The cooling water pressure computing section 14 computes the cooling water pressure of the cooling device 5 after the initial stage of rolling. The cooling water pressure after the initial stage of rolling is computed by using PI control etc. based on the target temperature of the rolled material 4 on the delivery side of the rolling mill, which is preset in the storage section 12, and the actual temperature value of the rolled material 4 detected by the finishing delivery temperature meter 10 in such a way that the difference between the target temperature and the actual temperature on the delivery side of the rolling mill is small.

Specifically, first, the cooling device 5 to be subjected to PI control (hereinafter, referred also to as the "controlled cooling device 5") is selected by the PI controlled object selecting section 15. As the cooling device 5 to be subjected to PI control, the cooling device arranged closest to the delivery side of the rolling mill among the cooling devices being operated, that is, the cooling device in which the cooling water pressure is higher than the lower limit pressure and does not reach a saturated state (upper limit pressure) is selected. The PI control section 16 computes and sets the cooling water pressure of the controlled cooling device 5 by using PI control in such a way that the difference between the target temperature of the rolled material 4 and the actual temperature thereof on the delivery side of the rolling mill is small. In the case where the cooling water pressure of the controlled cooling device 5 has reached the upper limit pressure as the result of the computation of the PI control section 16, the PI controlled object selecting section 15 changes the object to be subjected to PI control from the cooling device 5 that is made in a saturated state by the computation to the cooling device 5 arranged adjacently on the delivery side of the rolling mill. Also, in the case where the cooling water pressure of the controlled cooling device 5 has reached the lower limit pressure as the result of the computation of the PI control section 16, first, the cooling water pressure of the controlled cooling device 5 is set at the lower limit pressure. Then, the PI controlled object selecting section 15 changes the object to be subjected to PI control from the cooling device 5 that is set at the lower limit pressure by the computation to the cooling device 5 arranged adjacently on the entry side of the rolling mill.

Next, the operation of the temperature control device for a hot rolling mill, which has the above-described configuration, is explained concretely.

When the rolled material 4 begins to be rolled, first, the temperature of the rolled material 4 is detected by the finishing entry temperature meter 9. In the temperature controller 8, at the initial stage of rolling, the cooling water pressure of each of the cooling devices 5 is computed by the initial cooling water pressure computing section 13. The actual operation of the cooling device 5 at the initial stage of rolling is controlled by the cooling water pressure control device 7 based on the computation result of the initial cooling water pressure computing section 13.

The specific operation in the temperature controller 8 is as described below.

Before the sheet front end of the rolled material 4 arrives at the temperature detection position of the finishing delivery temperature meter 10, the temperature of the rolled material 4 on the delivery side of the rolling mill cannot be detected. Therefore, before the sheet front end of the rolled material 4 arrives at the temperature detection position of the finishing delivery temperature meter 10, the cooling device 5 to be operated and the cooling water pressure thereof are set based on the actual temperature value of the rolled material 4 detected by the finishing entry temperature meter 9, other predetermined parameters (for example, the target temperature, the speed pattern of the rolled material 4, etc.), and the learning function provided in advance, and cooling water is jetted out at the timing at which the sheet front end of the rolled material 4 is excluded.

At this time, the cooling device 5 to be operated is preferentially used in order from one closest to the entry side of the rolling mill until the upper limit pressure is reached as described above. That is to say, from the result of computation, in the case where desired cooling can be performed by only the cooling device 5*a* arranged closest to the entry side of the rolling mill, the rolled material 4 is cooled by using only the cooling device 5*a*. Specifically, the cooling water pressure of the cooling device 5*a* is set at an appropriate value between the lower limit pressure and the upper limit pressure by predetermined computation, and the cooling water pressure of each of the cooling devices 5*b* to 5*f* arranged on the delivery side of the rolling mill of the cooling device 5*a* is set at zero. That is to say, cooling water is not jetted out of the cooling devices 5*b* to 5*f*.

Also, when a plurality of cooling devices 5 must be used, for example, when the cooling devices 5*a* to 5*d* must be used, in the cooling devices other than the cooling device 5*d* arranged closest to the delivery side of the rolling mill of the used cooling devices 5*a* to 5*d*, the cooling water pressure is set at the upper limit pressure. The cooling water pressure of the cooling device 5*d* arranged closest to the delivery side of the rolling mill is set at an appropriate value between the lower limit pressure and the upper limit pressure by predetermined computation, by which the total cooling capacity is adjusted. At this time, the cooling water pressure of each of the cooling devices 5*e* and 5*f* is set at zero. That is to say, cooling water is not jetted out of the cooling devices 5*e* and 5*f*.

When the sheet front end of the rolled material 4 arrives at the temperature detection position of the finishing delivery temperature meter 10, the temperature of the rolled material 4 is detected by the finishing delivery temperature meter 10. The actual temperature value detected by the finishing delivery temperature meter 10 is supplied to the temperature controller 8. The temperature controller 8 starts the control of cooling water pressure by PI control based on the target temperature and the actual temperature value sent from the finishing delivery temperature meter 10 in such a way that the difference between the target temperature and the actual temperature is small.

Specifically, first, the controlled cooling device 5 is selected by the PI controlled object selecting section 15. When the controlled cooling device 5 is selected, the PI control section 16 carries out PI control in such a way that the difference between the target temperature of the rolled material 4 and the actual temperature thereof on the delivery side of the rolling mill is small, and computes the operation correction amount (correction amount of cooling water pressure) of the controlled cooling device 5. The cooling water pressure computing section 14 supplies a value obtained by adding the correction amount to the previous cooling water pressure of the controlled cooling device 5 to the corresponding cooling water pressure control device 7.

In the case where the cooling water pressure of the controlled cooling device 5 has exceeded the upper limit pressure as the result of the computation of the correction amount, first, the cooling water pressure of the controlled cooling device 5 is set at the upper limit pressure. Also, the object to be subjected to PI control is transferred from the cooling device 5 that has become in a saturated state as the result of the computation of the correction amount to the cooling device 5 arranged adjacently on the delivery side of the rolling mill. That is to say, the controlled cooling device 5 is changed by the PI controlled object selecting section 15. The PI control is carried out by the PI control section 16 on the controlled cooling device 5 after change, and the cooling water pressure is computed and set in such a way that the difference between the target temperature and the actual temperature is small.

Also, in the case where, contrary to the above description, the temperature of the rolled material 4 detected by the finishing delivery temperature meter 10 is lower than the target temperature, and the cooling water pressure of the controlled cooling device 5 has exceeded the lower limit pressure as the result of the computation of the correction amount, first, the cooling water pressure of the controlled cooling device 5 is set at the lower limit pressure. Also, the object to be subjected to PI control is transferred from the cooling device 5 whose cooling water pressure has been set at the lower limit pressure as the result of the computation of the correction amount to the cooling device 5 arranged adjacently on the entry side of the rolling mill. That is to say, the controlled cooling device 5 is changed by the PI controlled object selecting section 15. The PI control is carried out by the PI control section 16 for the controlled cooling device 5 after change, and the cooling water pressure is computed and set in such a way that the difference between the target temperature and the actual temperature is small.

For example, in the case where the upper limit pressure of the cooling device 5 is in advance set at 10 MPa, the lower limit pressure thereof is set at 2 MPa, and the pressure of the cooling device 5 necessary for the cooling of the rolled material 4 at the initial stage of rolling is set at 10 MPa for the cooling device 5*a* between the F1 stand and the F2 stand and at 7 MPa for the cooling device 5*b* between the F2 stand and the F3 stand, when the rolled material 4 arrives at the temperature detection position of the finishing delivery temperature meter 10, the PI control is carried out for the cooling device 5*b*.

In the case where the temperature of the rolled material 4 detected by the finishing delivery temperature meter 10 is higher than the target temperature, and the cooling of the rolled material 4 is insufficient, when the cooling water pressure of the cooling device 5*b* that is to be subjected to PI control reaches 10 MPa, the object to be subjected to PI control is transferred to the cooling device 5*c* between the F3 stand and the F4 stand, and the computation of cooling water pressure is started. That is to say, at this point of time, the cooling water pressure of the cooling device 5*a* is set at 10 MPa, the cooling water pressure of the cooling device 5*b* is set at 10 MPa, and the cooling water pressure of the cooling device 5*c* is in a state of being subjected to PI control.

On the other hand, in the case where the temperature of the rolled material 4 detected by the finishing delivery temperature meter 10 is lower than the target temperature, and the rolled material 4 has been cooled excessively, when the cooling water pressure of the cooling device 5*b* that is to be subjected to PI control decreases to 2 MPa, the object to be subjected to PI control is transferred to the cooling device 5*a*, and the computation of cooling water pressure is started. That is to say, at this point of time, the cooling water pressure of the cooling device 5*a* changes from 10 MPa to a state of being subjected to PI control, and the cooling water pressure of the cooling device 5*b* is in a state of being 2 MPa.

FIG. 2 shows one example of the operation of the temperature controller 8 after the sheet front end of the rolled material 4 has arrived at the temperature detection position of the finishing delivery temperature meter 10. In FIG. 2, reference numeral 17 denotes a temperature control function (proportional integrator), 18 denotes a temperature control limiter, and 19 denotes a valve opening control function (instrumentation controller). When the valve opening of the cooling device 5 reaches the open limit, the control loop is transferred to a downstream stand, and when the valve opening of the cooling device 5 reaches the close limit, the control loop is transferred to an upstream stand, by which the above-described operation is carried out.

On the other hand, for the cooling device 5 to be subjected to PI control, the total manipulated variable $Q_n$ of cooling water pressure is calculated by the following formula.

$$Q_n = Q1_n(\text{set pressure}) + Q2_n(PI\ \text{control output}) \quad \text{[Formula 1]}$$

$$Q2_n = (Kp_n + Ki_n/s) \times (Tf - Ta) \quad \text{[Formula 2]}$$

in which, Tf is the actual temperature, Ta is the target temperature, n is a cooling device between the object stands. Also, in the case where the upper limit pressure of the cooling device 5 is set at 10 MPa, and the lower limit pressure thereof is set at 2 MPa, when the result of Formula 1 is $Q_n$>10 MPa, Formula 3 holds, and when the result thereof is $Q_n$<2 MPa, Formula 4 holds.

$$Q_{n+1}=Q1_{n+1}(=0)+Q2_{n+1},\ Q_n=10\ \text{MPa} \quad \text{[Formula 3]}$$

$$Q_{n-1}=Q1_{n-1}+Q2_{n-1},\ Q_n=2\ \text{MPa} \quad \text{[Formula 4]}$$

Also, the sheet thickness on the delivery side of the rolling mill yielded by the hot finish rolling mill is generally expressed by the following formula.

$$h_n=F_n/M_n \quad \text{[Formula 5]}$$

in which, h is the sheet thickness on the delivery side of the rolling mill, F is a load applied to the rolling mill, M is a mill plasticity factor, and n is the object rolling mill.

Figure 3:
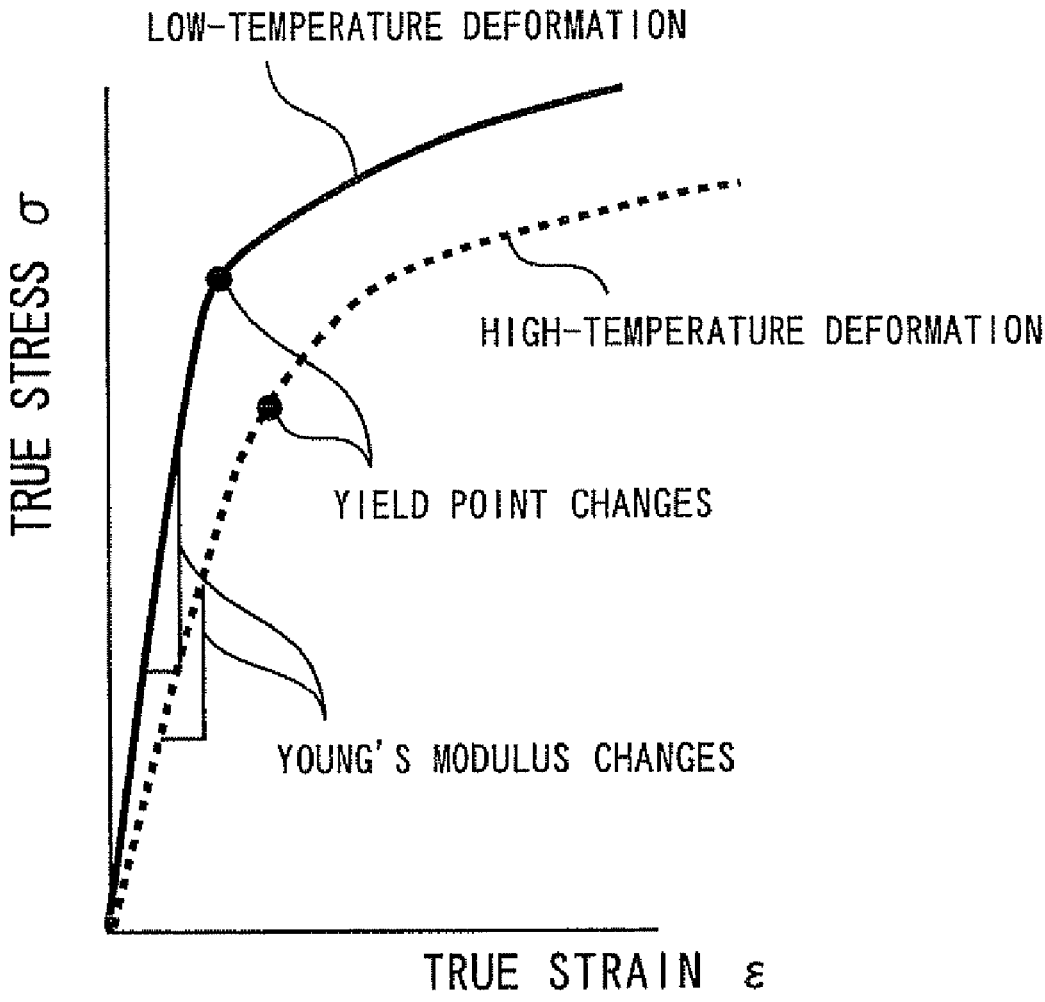
FIG. 3 is a graph showing the relationship between the true stress and the true strain of rolled material.

If the mill plasticity factor of rolling mill is constant, the sheet thickness varies depending on the load applied to the rolling mill. FIG. 3 is a graph showing the relationship between the true stress and the true strain of rolled material. As shown in FIG. 3, it is found that, when it is desired to obtain the same strain, the deformation of the rolled material 4 requires greater stress as the rolled material 4 is cooled more. Also, since the mill plasticity factor of the rolled material 4 increases as the rolled material 4 is cooled, the rolled material 4 is hardened, and therefore the load (stress) applied to the rolling mill increases. As a result, the sheet thickness on the delivery side of the rolling mill becomes larger than the target thickness. Inversely, if the rolled material 4 is rolled without being cooled, the load applied to the rolling mill decreases. As a result, the sheet thickness on the delivery side of the rolling mill becomes smaller than the target thickness.

The auto gauge control of the hot finish rolling mill means control for obtaining the target thickness over the total length of the rolled material 4 by gradually decreasing the thickness of the rolled material 4 by using a plurality of rolling mills and by smoothening the surface of the rolled material 4 (making the deviation in sheet thickness of a sheet steady-state part smaller than a predetermined value) in the process of decreasing the thickness of the rolled material 4. Therefore, if the change in sheet thickness is increased by the occurrence of a sudden temperature change near the delivery side of the hot finish rolling mill, the number of rolling mills capable of correcting the sheet thickness by the auto gauge control (AGC) decreases, so that the disturbance against the auto gauge control increases, and therefore the fluctuations in sheet thickness cannot be restrained. That is to say, there arises a problem in that the deviation in sheet thickness of the steady-state part of the rolled material 4 increases. This phenomenon means that if the cooling capacity is increased to improve the accuracy of temperature control of the rolled material 4 near the delivery side of the rolling mill, the accuracy of sheet thickness of the rolled material 4 is influenced. If it is desired to improve the accuracy of sheet thickness, the temperature control of the rolled material 4 must be restrained.

According to the first embodiment of the present invention, the aforementioned problem can be solved. Specifically, the sudden temperature change of the rolled material 4 near the delivery side of the hot finish rolling mill can be prevented, the disturbance against the auto gauge control (AGC) can be decreased, and the auto gauge control (AGC) in the plurality of rolling mills can be used effectively. Therefore, the temperature and sheet thickness of the rolled material 4 can be controlled with high accuracy, and therefore high-quality products can be manufactured easily.

INDUSTRIAL APPLICABILITY

As described above, according to the temperature control device for a hot rolling mill in accordance with the present invention, auto gauge control (AGC) using a plurality of rolling mills can be used effectively, and the temperature and sheet thickness of a rolled material can be controlled with high accuracy. Therefore, high-quality products can be provided.

The invention claimed is:

1. A temperature control device for a hot rolling mill having a plurality of rolling stands, arranged in a row, for rolling a heated rolled material, in succession, using the plurality of rolling stands, the temperature control device comprising:

a plurality of cooling devices, each cooling device being located between a different, respective pair of the plurality of rolling stands, to cool the rolled material by spraying cooling water;

an entry side temperature meter for detecting the temperature of the rolled material on an entry side of the rolling mill;

a delivery side temperature meter for detecting the temperature of the rolled material on a delivery side of the rolling mill;

a first cooling water pressure computing section which computes cooling water pressure of the cooling devices so that the cooling devices are preferentially used, in order, from the one of the cooling devices that is closest to the entry side of the rolling mill, until an upper limit pressure is reached, based on a target temperature of the rolled material on the delivery side of the rolling mill, and the temperature actually detected by the entry side temperature meter, wherein the first cooling water pressure computing section computes the cooling water pressure of the cooling device only during an initial stage of rolling, from before a front end of the rolled material enters the rolling mill and until the first end of the rolled material arrives at a temperature detection position of the delivery side temperature meter;

a second cooling water pressure computing section which computes, for the cooling devices in operation, the cooling water pressure of the cooling device that is closest to the delivery side of the rolling mill, based on the target temperature of the rolled material and the temperature actually detected by the delivery side temperature meter at the temperature detection position of the delivery side temperature meter, so that the difference between the target temperature and the temperature actually detected by the delivery side temperature meter at the delivery side of the rolling mill is minimized; and a controlled object selecting section configured so that when the cooling water pressure of the cooling device that is being controlled by the second cooling water pressure computing section reaches an upper limit pressure, as computed by the second cooling water pressure computing section, the controlled object selecting section changes the controlled object controlled by computation of the second cooling water pressure computing section to the one of the cooling devices that is next closest to the delivery side of the rolling mill, and when the cooling water pressure of the cooling device that is being controlled by the second cooling water pressure computing section reaches a lower limit pressure, as computed by the second cooling water pressure computing section, the controlled object selecting section changes the controlled object controlled by computation of the second cooling water pressure computing section to the one of the cooling devices that is next closest to the entry side of the rolling mill.

* * * * *